US009399153B2

(12) United States Patent
Green

(10) Patent No.: US 9,399,153 B2
(45) Date of Patent: Jul. 26, 2016

(54) EXERCISE AND SPORTING APPARATUS

(71) Applicant: Mario Green, New York, NY (US)

(72) Inventor: Mario Green, New York, NY (US)

( * ) Notice: Subject to any disclaimer, the term of this patent is extended or adjusted under 35 U.S.C. 154(b) by 90 days.

(21) Appl. No.: 14/287,121

(22) Filed: May 26, 2014

(65) Prior Publication Data

US 2014/0349818 A1 Nov. 27, 2014

Related U.S. Application Data

(60) Provisional application No. 61/827,719, filed on May 27, 2013, provisional application No. 61/869,906, filed on Aug. 26, 2013.

(51) Int. Cl.

| | |
|---|---|
| ***A63B 21/00*** | (2006.01) |
| ***A63C 17/00*** | (2006.01) |
| ***A63B 5/11*** | (2006.01) |
| ***A63B 21/02*** | (2006.01) |
| ***A63B 23/035*** | (2006.01) |
| ***A63B 25/10*** | (2006.01) |
| ***A63C 17/06*** | (2006.01) |
| *A63B 5/08* | (2006.01) |

(52) U.S. Cl.

CPC ..... *A63B 21/1426* (2013.01); *A63B 5/11* (2013.01); *A63B 21/0004* (2013.01); *A63B 21/026* (2013.01); *A63B 21/4013* (2015.10); *A63B 21/4015* (2015.10); *A63B 23/03508* (2013.01); *A63B 23/03541* (2013.01); *A63B 25/10* (2013.01); *A63C 17/0046* (2013.01); *A63C 17/065* (2013.01); *A63B 5/08* (2013.01)

(58) Field of Classification Search

CPC ..... A63B 21/00
USPC ..... 482/77, 79, 124, 122
See application file for complete search history.

(56) References Cited

U.S. PATENT DOCUMENTS

| | | | | |
|---|---|---|---|---|
| 4,492,374 | A | 1/1985 | Lekhtman et al. | |
| 5,205,798 | A | 4/1993 | Lekhtman | |
| 5,643,148 | A * | 7/1997 | Naville | 482/77 |
| 6,436,012 | B1 | 8/2002 | Naville | |

* cited by examiner

*Primary Examiner* — Jerome w Donnelly
(74) *Attorney, Agent, or Firm* — Patentfile, LLC; Bradley C. Fach; Steven R. Kick

(57) ABSTRACT

A novel exercise and sporting apparatus with improved safety features is disclosed. In preferred embodiments, the apparatus comprises: a first resilient arched member having two opposite end zones, and being configured to securely engage with a foot receiving member; a second resilient arched member having two opposite end zones, and being configured to contact a ground surface; a connection element being configured to connect an end zone of the first resilient arched member with an end zone of the second resilient arched member, and a rotation-opposing assembly extending from the connection element toward a ground surface, the rotation-opposing assembly being configured to limit an amount of rotational motion of the apparatus.

13 Claims, 11 Drawing Sheets

EXERCISE AND SPORTING APPARATUS

CROSS REFERENCE TO RELATED APPLICATIONS

The present application is a non-provisional of, and claims priority to, co-pending provisional patent application Nos. 61/827,719 and 61/869,906 filed on May 27, 2013 and Aug. 26, 2013 respectively. The entire contents of both above-referenced patent applications are incorporated by reference herein.

FIELD OF THE INVENTION

The present invention relates to the field of sporting and exercise equipment and in particular to novel exercising and sporting footwear apparatuses.

BACKGROUND

Sporting and exercise footwear are well known in the art. In particular, boots which contain a spring mechanism are known to absorb impact forces, increase muscle, and build cardiovascular performance. This bouncing footwear typically is used for physical fitness routines that incorporate bouncing, jumping, and plyometric exercises.

Bouncing footwear devices are known in the art as shown, for example, in U.S. Pat. No. 4,492,374 issued to Lekhtman et al on Jan. 8, 1985. As shown by this patent, the main unit has a spring member that is permanently attached to the foot receiving member. This can be inconvenient especially during storage and transport and prevents individual components from being replaced. Also, the layers which form the spring member are attached to each other and to an adjustment mechanism not capable of disassembly.

U.S. Pat. No. 5,205,798 granted to Gregory Lekhtman on Apr. 27, 1993, describes a sporting and exercising device comprising a foot receiving portion and a spring portion detachably attached to the bottom face of the foot receiving portion. A major drawback of this sporting and exercising device is that the spring portion collapses after about 7 centimeters (cm) (out of about 13 cm) of deformation by compression and lacks a smooth even elasticity. This reduces the ability to absorb increasing higher impact energies, thereby reducing the available bouncing power.

U.S. Pat. No. 5,643,148 granted to Denis Naville on Jul. 1, 1997 describes a sporting and exercising device comprising an upper foot-receiving portion and a lower spring portion. However, the resilient shock absorbing bodies disclosed prevent the spring portion from further collapse after a certain deformation by compression has been reached. A major drawback of this device is that the lower spring layer easily disassembles during higher impacts even on level surfaces. When a user is running in the device and accidentally engages the safety, the bottom layer disassembles causing the user to fall and or break ankles from landing on the disassembled top portion of the device.

Another drawback of this device is that there are only four resilient shock absorbers. This limits the return energy after an impact so the user is not able to maximize their bounce or rebound. Also, the shock absorbers are situated in the center of the elastic band and when the boot compresses it compromises the lateral stability of the device which results in the device unstably rocking left or right causing the user to easily disengage the lower spring layer. Another drawback is that the upper foot receiving portion sits completely flat on the lower spring portion. This forces the user's foot to stay in a forced flexed position throughout an exercise session which is extremely uncomfortable for the user causing the boot to rub against the skin.

A further drawback of the device is that it is extremely heavy creating a tendency for users to drag their feet while using the device. This leads to improperly compression of the device and decreases the life of the device and it's parts.

Another drawback is that the four resilient shock absorbers are slid into place which means under the repeated force of compressing the unit the shock absorbers have a high chance of sliding out resulting in failure of the unit which could cause potentially fatal harm to the user. Another major drawback is that the bottom tread on the lower layer does not extend a significant length of the ground contacting surface. If a user leans too far forward or too far back the tread may cease to contact the ground causing the user to skid on the exposed plastic shell and possibly fall injuring themselves. Another drawback of the device is that if a user does not have good balance or strong stability muscles they can fall forward if they go too far forward in the device or fall back if they go too far back in the device. There is nothing physically on the shoe such as a brake to prevent falling forward or falling back making users uncomfortable and afraid to try the device.

Based on the above-mentioned drawbacks, there is a strong need in the field for new and improved advanced sporting and exercise footwear devices. There is a further need for devices and apparatuses that are able to promote user safety and confidence. There is also a need for footwear apparatuses capable of being reconfigured for different activities and for replacement or substitution of the various components.

BRIEF SUMMARY OF THE INVENTION

It is one aspect of the present invention to provide a novel exercise and sporting footwear apparatus designed to allow the user to perform jumping and bouncing activities. In preferred embodiments, the apparatus comprises: a first resilient arched member having two opposite end zones, and being configured to securely engage with a foot receiving member; a second resilient arched member having two opposite end zones, and being configured to contact a ground surface; a connection element being configured to connect an end zone of the first resilient arched member with an end zone of the second resilient arched member, and further comprising a rotation-opposing assembly extending from the connection element toward a ground surface, the rotation-opposing assembly being configured to limit an amount of rotational motion of the apparatus.

It is another aspect of the present invention to provide a novel exercise and sporting footwear apparatus designed to be able to be reconfigured to accomplish a variety of different exercising activities. In other preferred embodiments, the apparatus comprises a boot accessory, wherein the boot accessory comprises an interface assembly configured to slidably and temporarily secure to a complementary interface assembly of a foot receiving member. In this regard, the apparatus of the present invention is able to connect and mate with a plurality of different sporting and exercise attachments such as rollerblades, ice skates, skis, snowboards, snow shoes, etc. and the like.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

Figure 1:
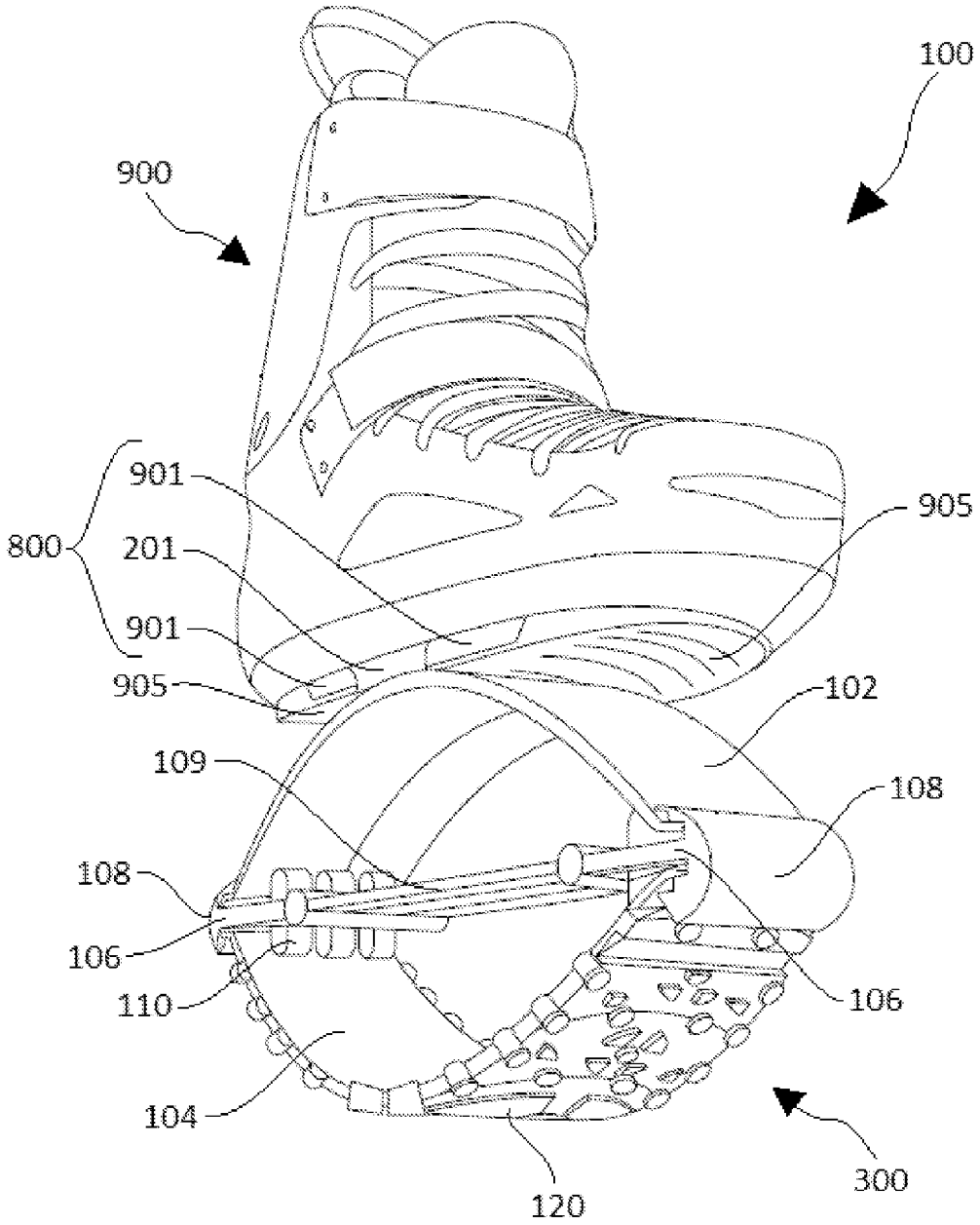
FIG. 1 depicts a front perspective view of an example of an exercise and sporting footwear apparatus according to various embodiments of the present invention.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

It should be understood that for the purposes of understanding the orientation of individual elements of the invention, the term "front" shall generally be used to indicate the positioning of a member or an element that when assembled in an exercise and sporting footwear apparatus is positioned substantially closer to the toe area of the footwear apparatus than to the heel area.

It should also be understood that for the purposes of understanding the orientation of individual elements of the invention, the terms "rear" and "back" shall generally be used to indicate the positioning of a member or an element that when assembled in an exercise and sporting footwear apparatus is positioned substantially closer to the heel area of the footwear apparatus than to the toe box.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New exercise and sporting footwear apparatuses are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 depicts an example of an exercise and sporting footwear apparatus ("the apparatus") 100 according to various embodiments. In this example, the apparatus 100 comprises a foot receiving member 900 and a boot accessory 300 configured in this example to increase a user's ability to bounce, jump, and do plyometrics. The foot receiving member 900 is configured to secure to a user's right or left foot and is made from materials common in the art of athletic footwear and may preferably contain a hard plastic outer shell. A connection apparatus 800 is shown in this example which comprises a first interface assembly 901 located on the foot receiving member 900 and a second interface assembly 201 located on the boot accessory 300. The connection apparatus 800 is configured to provide removable engagement and attachment between the foot receiving member 900 and a boot accessory 300. In this example, the boot accessory 300 comprises an elongate tension member 109 with two rotation opposing assemblies 108, a first resilient arched member 102 and a second resilient arched member 104. Self balancing tread 120 mounted on substantially all of the ground facing surface of the second resilient arched member 104 is shown.

Figure 2:
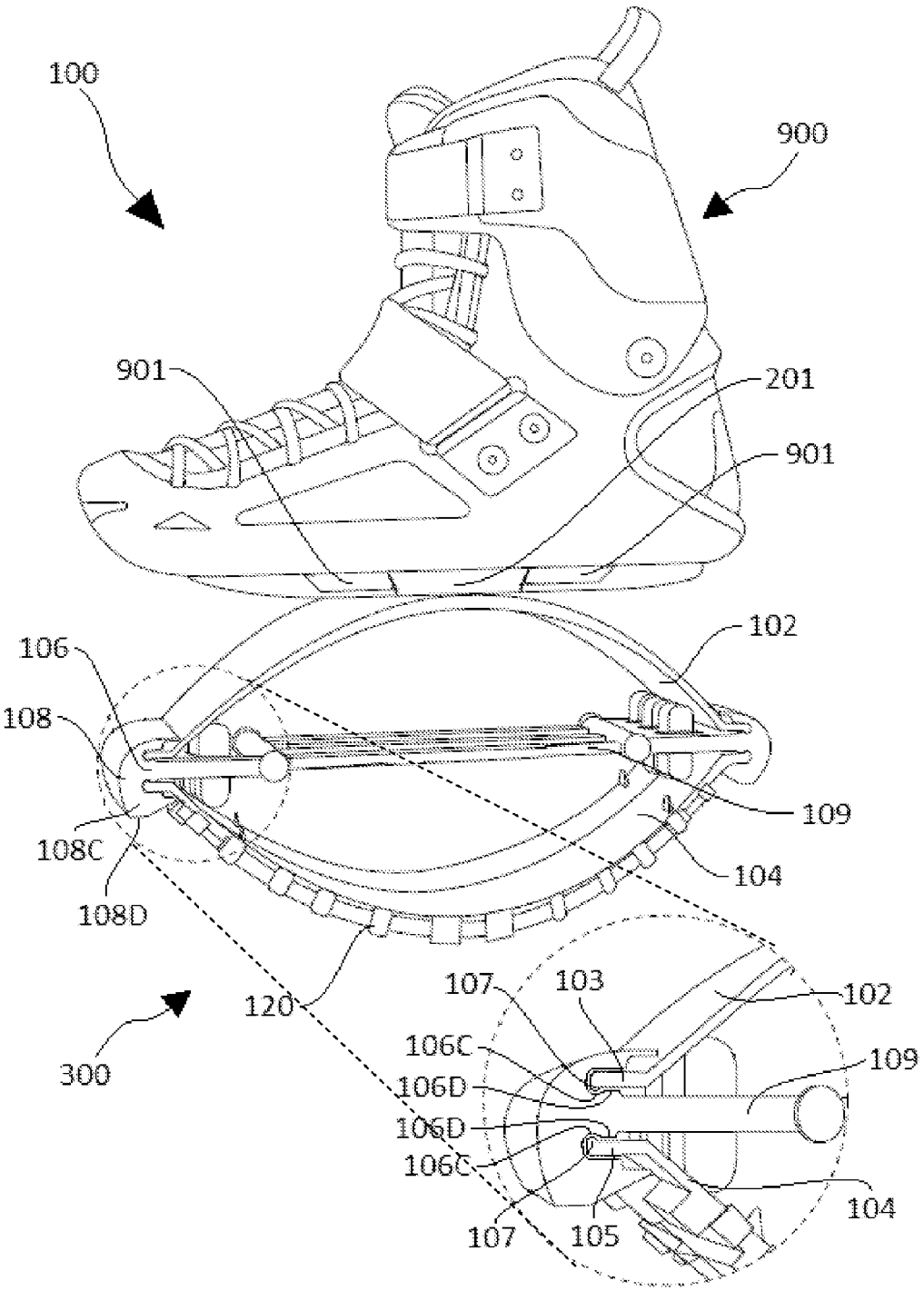
FIG. 2 illustrates a side profile view of an example of an exercise and sporting footwear apparatus according to various embodiments described herein.

FIG. 2 illustrates a side profile view of an example of an exercise and sporting footwear apparatus 100 according to various embodiments described herein. In this embodiment, the boot accessory 300 comprises a first resilient arched member 102 and a second arched resilient member 104 which may be made from resilient materials such as plastic, metal alloys, carbon fiber and other suitable materials capable of deforming under load and resuming their original shape upon removal of a load. The first resilient arched member 102 further comprises two end zones 103 with one end zone 103 located at the front side (e.g. toe side) of the first resilient arched member 102 and one end zone 103 located at the rear side (e.g. heel side) of the first resilient arched member 102. The second resilient arched member 104 comprises two end zones 105 with one end zone 105 located at the front side (e.g. toe side) of the second resilient arched member 104 and one end zone 105 located at the rear side (e.g. heel side) of the second resilient arched member 104. In preferred embodiments, a locking edge 107 is positioned on the terminus of each of the front and rear end zones 103 and on the terminus of each of the front and rear end zones 105. Locking edge 107 is preferably formed by the ends of the first resilient arched member 102 and second resilient arched member 104 wherein the end is bent or formed at a substantially right angle and configured to contact raised edges 106D within receiving pockets 106C of connection element 106.

A front connection element 106 and rear connection element 106 are configured to removably secure the first resilient arched member 102 and the second resilient arched member 104 of the boot accessory 300 in the embodiment shown by FIG. 2. In this example, the connection element 106 comprises two receiving pockets 106C and two raised edges 106D which are configured to secure the locking edge 107 on an end zone 103 and the locking edge 107 on an end zone 105.

Still referring to FIG. 2, in preferred embodiments, a rotation opposing assembly 108 and a connection element 106 are integrally formed or permanently attached to the front and back of an elongate tension member 109. In other embodiments, a rotation opposing assembly 108 may be temporarily or removably attached to a front connection element 106 and a back connection element 106 with both connection elements 106 molded into an elongate tension member 109. The connection elements 106 may be made from durable and elastic materials such as silicone, rubber, plastic, or any other suitable material.

The rotation opposing assemblies 108 may comprise lateral extension region 108C and a ground contacting region 108D both of which may be formed integral to rotation opposing assembly 108 or may be removably connected or secured to rotation opposing assembly 108. In some embodiments, the lateral extension regions 108C of various lengths may be temporarily or permanently attached to the rotational assembly 108 to position replaceable ground contacting regions 108D closer or further from the ground surface (FIG. 4). The ground contacting region 108D may have a terminal end substantially planar in shape (shown by example in FIG. 2), convex in shape, or any other geometric and non-geometric shape as suited for making contact with ground surfaces such as concrete and asphalt.

Figure 3:
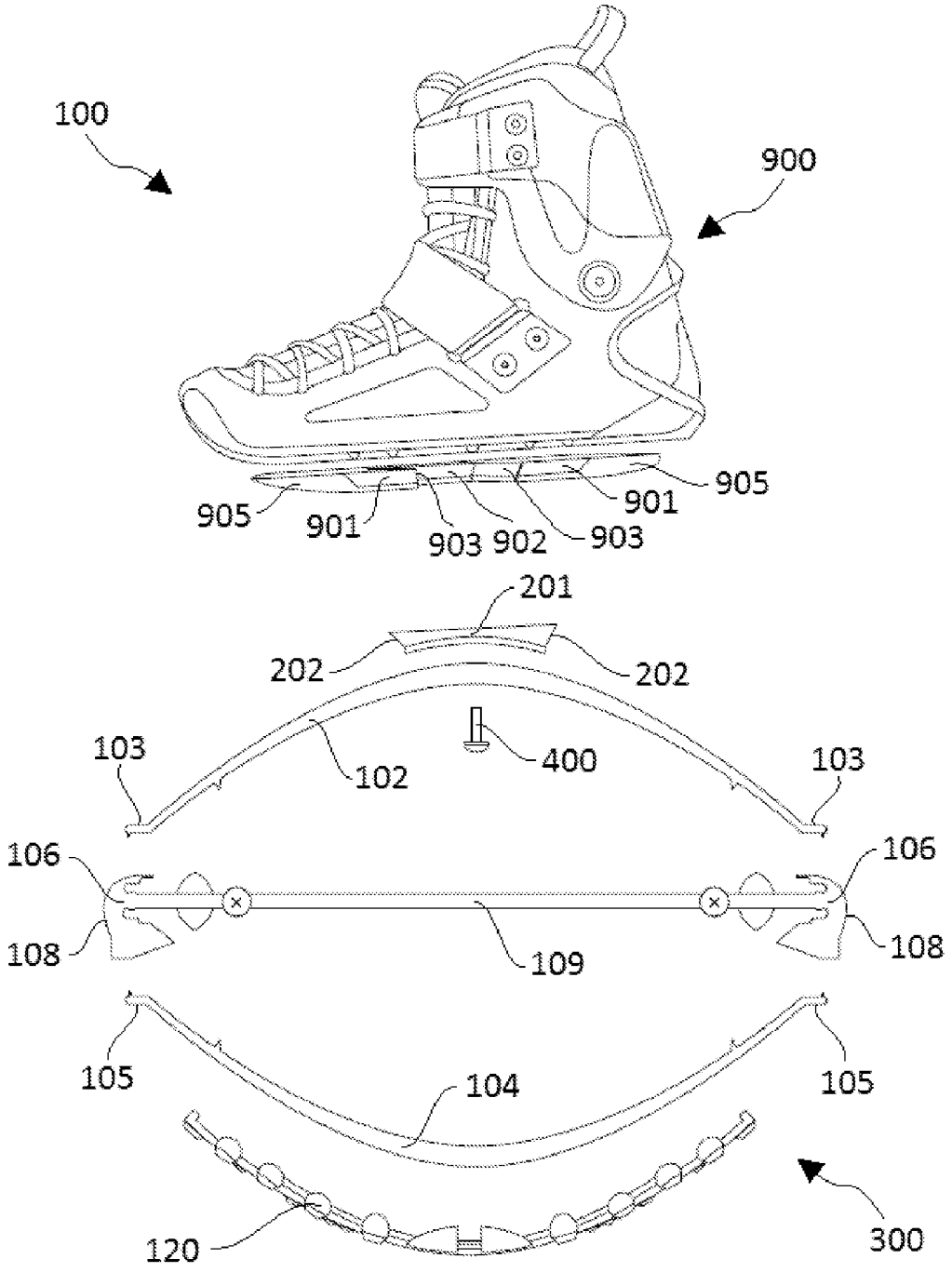
FIG. 3 shows an exploded side profile view of an example of an exercise and sporting footwear apparatus according to various embodiments described herein.

Turning now to FIG. 3 an exploded side profile view of an example of an exercise and sporting footwear apparatus 100 according to various embodiments is shown. In this example, the modular nature of the apparatus 100 is aptly illustrated. A first resilient arched member 102 and second resilient arched member 104 are configured to be temporarily attached to an elongate tension member 109 by way of two connection elements 106. An optionally removable self balancing tread 120 is configured to be attached to the second resilient arched member 104. The self balancing tread 120 provides a non-slip surface for contacting a ground surface. Suitable materials for the self balancing tread 120 include rubber, silicone, soft plastics, or any other material comprising the soles of footwear. In some embodiments, the self balancing tread 120 may be temporarily attached to the second resilient arched member 104 with a plurality of removable fasteners or other suitable temporary attachment, or permanently attached with glue, epoxy, heat bonding, chemical bonding, or any other suitable permanent attachment.

In this embodiment, a second interface assembly 201, comprising two or more male side walls 202, is configured to be temporarily attached to the first resilient arched member 102. In preferred embodiments, the second interface assembly 201 is configured to be permanently attached or integrally formed into the first resilient arched member 102.

In this example, the second interface assembly 201 located on the upper surface of the first resilient arched member 102 of this particular boot accessories 300 may be temporarily secured to a first interface assembly 901 of the foot receiving member 900. In preferred embodiments, both the second interface assembly 201 and the first interface assembly 901 may be made from rigid and durable materials such as metal alloys, hard plastics, ceramics, carbon fiber, or any other suitable material. Also in preferred embodiments, one or more plate covers 905 are positioned over the first interface assembly 901 and attached to the sole region of the foot receiving member 900 to provide a non-slip surface for the user to walk on when wearing the foot receiving member 900 without an attached boot accessory 300. Suitable materials for the plate covers 905 include rubber, silicone, soft plastics, or any other material comprising the soles of footwear. In preferred embodiments, the first interface assembly 901 is integrally formed or permanently attached to the foot receiving member 900. In other embodiments, the first interface assembly 901 is temporarily attached to the foot receiving member 900 with a plurality of fasteners such as screw type, rivet type, and the like.

The second interface assembly 201 is configured to slidably engage into a recessed opening 902 which is preferably formed by a substantially "C" shaped first interface assembly 901 which comprises two or more female side walls 903 which may be angled as shown by the figures. The female side walls 903 engage the complementary shaped male side walls 202 so that the boot accessory 300 may only be disengaged from the foot receiving member 900 by sliding each piece in opposite directions and preferably by sliding the boot accessory 300 in a lateral direction away from the foot receiving member 900.

In preferred embodiments, the sliding motion as discussed above is prevented by inserting a fastener 400 through a fastener aperture which passes through the first resilient arched member 102, the second interface assembly 201, and into the sole area of the foot receiving member 900. The fastener 400 is preferably a threaded type fastener that may be tightened and loosened without the need for tools. In some embodiments, two or more fasteners 400 may be used to temporarily secure the boot accessory 300 to the foot receiving member 900 and may be made from rigid and durable materials such as metal alloys, hard plastics, ceramics, carbon fiber, or any other suitable material.

Figure 4A:
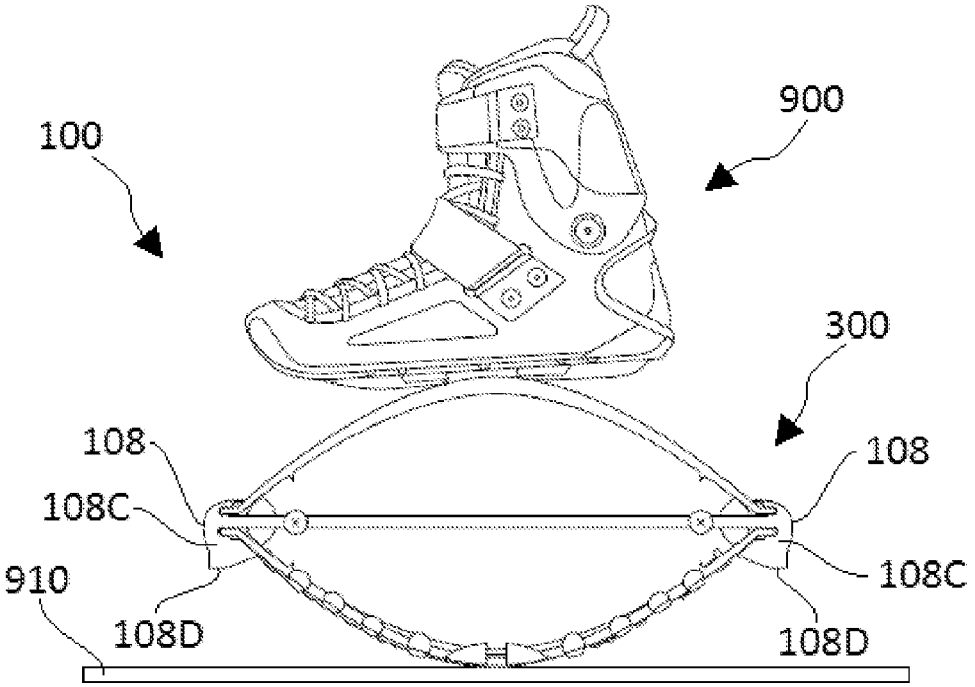
FIG. 4A depicts a first side profile view of an example of an exercise and sporting footwear apparatus positioned on a ground surface according to various embodiments described herein.

FIG. 4 depicts two side profile views of an example of an exercise and sporting footwear apparatus 100 positioned on a ground surface 910 according to various embodiments. In FIG. 4A, the apparatus 100 is depicted in a substantially level orientation with the sole of the foot receiving member 900 parallel to the ground surface 910. In this example, the apparatus 100 comprises one or more rotation opposing assemblies 108 located proximate to the connection element 106. The rotation opposing assembly 108 and its sub-regions or sub-components may be made from durable impact absorbing materials such as rubber, silicone, hard and soft plastics, or other suitable materials.

Figure 4B:
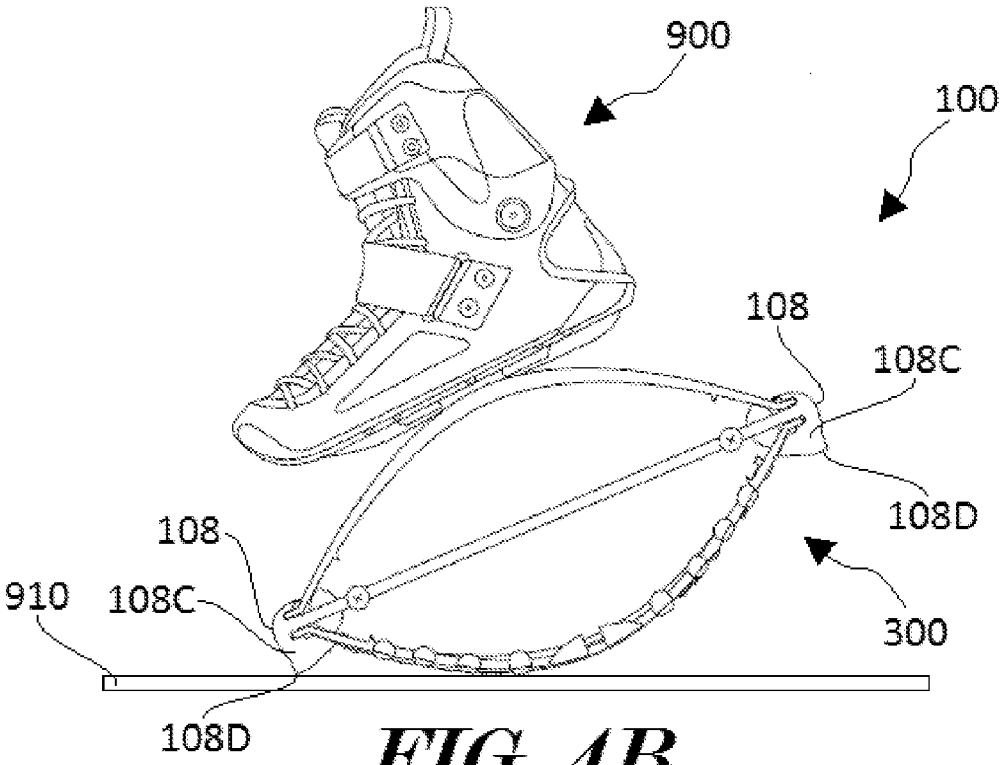
FIG. 4B depicts a second side profile view of an example of an exercise and sporting footwear apparatus positioned on a ground surface according to various embodiments described herein.

As perhaps best illustrated in FIG. 4B, the ground contacting region 108D of the rotation opposing assembly 108 contacts the ground surface 910 to limit rotational movement of the apparatus 100 which could result in injury to the user. The limit of the rotational movement or rotational threshold of the apparatus 100 may be decreased by increasing the dimensions of the lateral extension region 108C thereby decreasing the distance between the ground contacting region 108D and the ground surface 910 when the apparatus 100 is rotated or pitched either forward or backward (e.g. towards the toe or heel side). Conversely, the limit of the rotational movement or rotational threshold of the apparatus may be increased by decreasing the dimensions of the lateral extension region 108C thereby increasing the distance between the ground contacting region 108D and the ground surface 910. In some embodiments, rotation opposing assemblies 108 comprise larger dimensioned and smaller dimensioned lateral extension regions 108C which may be temporarily or removably attached to the apparatus 100 and in particular to the connection element 106. In some embodiments, the rotational movement may be limited to a larger degree, with larger dimensioned lateral extension regions 108C, for novice users. In other embodiments, the rotational movement may be limited to a smaller degree, with smaller dimensioned lateral extension regions 108C, for advanced users. Although FIG. 4 provides an example of an apparatus 100 with two rotation opposing assemblies 108, it is provided herein that the apparatus 100 may be configured with only one rotation opposing assemblies 108 located proximate to either the front connection element 106 or rear connection element 106. In some alternative embodiments, the apparatus 100 may be configured without any rotation opposing assemblies 108.

Figure 5A:
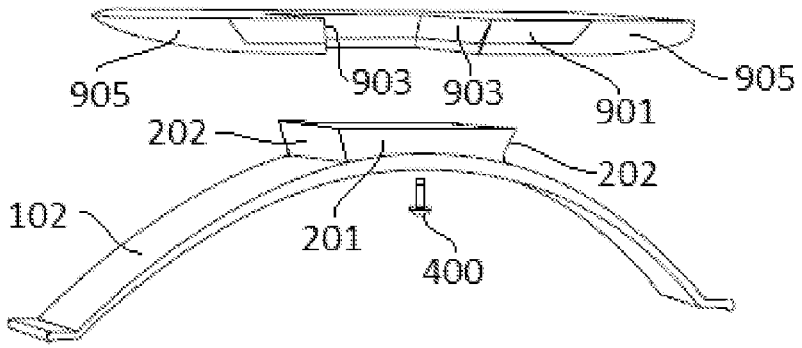
FIG. 5A illustrates a side profile view of an example of a first interface assembly disengaged from a second interface assembly an exercise and sporting footwear apparatus according to various embodiments described herein.
Figure 5B:
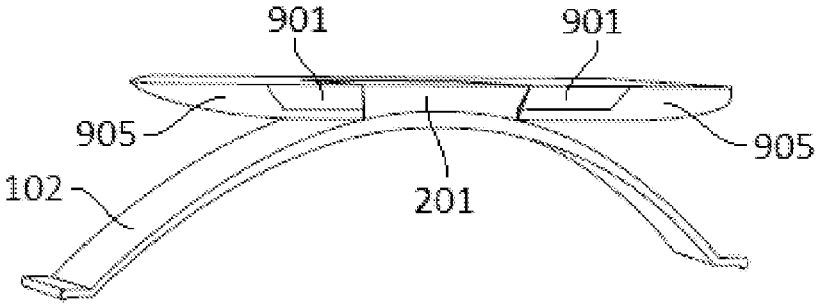
FIG. 5B illustrates a side profile view of an example of a first interface assembly engaged with a second interface assembly an exercise and sporting footwear apparatus according to various embodiments described herein.
Figure 5C:
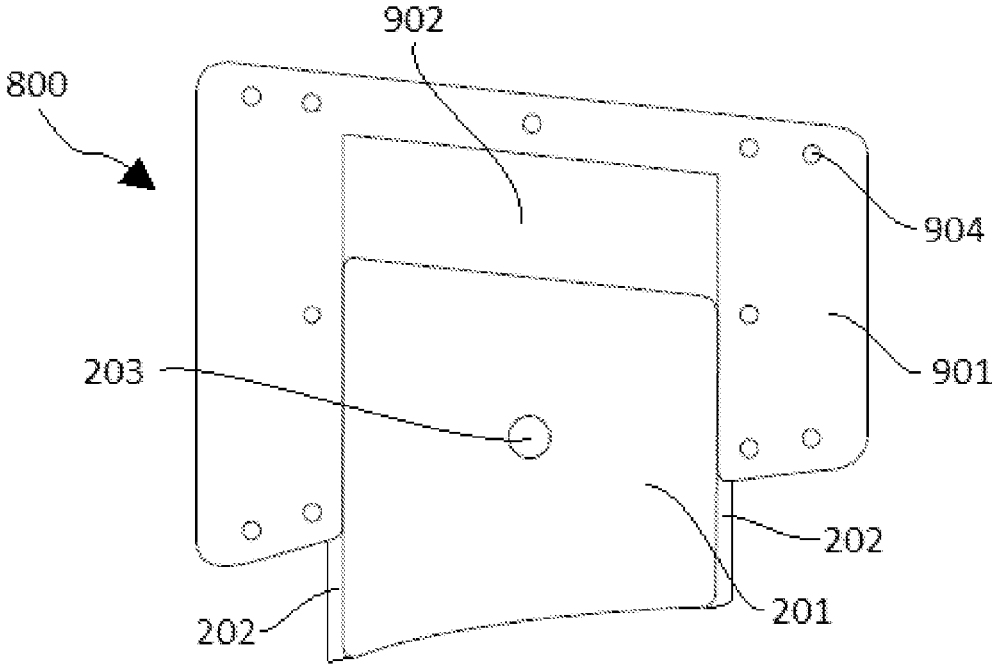
FIG. 5C illustrates a bottom view of an example of a first interface assembly partially engaged with a second interface assembly together which become a connection apparatus of an exercise and sporting footwear apparatus according to various embodiments described herein.

Turning now to FIG. 5, three views are provided of the engagement of a first interface assembly 901 and a second interface assembly 201. FIG. 5A illustrates a side profile view of an example of a first interface assembly 901 disengaged from a second interface assembly 201 according to various embodiments of the present invention. In this example, the female side walls 903 of the first interface assembly 901 are configured to contact and receive the male side walls 202 of the second interface assembly 201. In this embodiment, female sidewalls 903 comprise a first female side wall which is sloped at a first angle relative to the plane of the sole region of the foot receiving member and a second female sidewall opposite to said first female sidewall 903 which is sloped at a second angle relative to the plane sole region of the foot receiving member (900). Said first female sidewall 903 and said second female sidewall 903 forming part of the perimeter wall for recessed opening 902 (FIG. 5C). Also shown by this example, a first male side wall is sloped at an angle corresponding to (i.e. at about the same degree of an angle) said first angle and a second male side wall is sloped at an angle corresponding to said second angle whereby said first male sidewall engages and rests upon said first female sidewall and said second male sidewall engages and rests upon said second female sidewall thereby preventing vertical movement between the first interface assembly 901 and second interface assembly 201 when they are engaged with one-another.

Once the second interface assembly 201 is slidably engaged (i.e. slides into and is held in place) with the first interface assembly 901 as shown in FIG. 5B, one or more fasteners 400 (FIG. 5A) may be used to prevent the interface assemblies from slidably disengaging and separating by inserting one or more fasteners 400 into one or more securing fastener apertures 203 (FIG. 5C) of the second interface 201 and into the footwear receiving member 900 (FIGS. 1, 2, and 3). Due to the angled nature of the female side walls 903 and the complementary angled male side walls 202 in this embodiment, the interface assemblies (901/201) may only be engaged and disengaged by sliding the second interface assembly 201 into and out of the recessed opening 902 of the first interface assembly 901 in a horizontal fashion and vertical movement is not permitted.

FIG. 5C illustrates a bottom up view of an example of a connection apparatus 800 comprising a first interface assembly 901 partially engaged with a second interface assembly 201. The generally "C" shape of the first interface assembly 901 can be seen which forms a recessed opening 902 in which the second interface assembly 201 is configured to completely fill and occupy. In some embodiments, one or more mounting apertures 904 are configured to receive fasteners which may be positioned on the first interface assembly 901 and may be configured to secure the first interface assembly 901 to the footwear receiving member 900 (FIGS. 1, 2, and 3).

In other embodiments, the first interface assembly 901 may be integrally formed into the footwear receiving member 900 (FIGS. 1, 2, and 3) or otherwise permanently attached with glue, epoxy, heat bonding, chemical bonding, or other substantially permanent attachment.

Still referring to FIG. 5C, in preferred embodiments, the shape of the recessed opening 902 is non-uniform in nature and may be formed by perimeter sidewalls of unequal length, of varying angles, shapes, grooves, etc. The male perimeter sidewalls 202 of second interface assembly 201 are configured to fit within the non-uniform sized recessed opening 902 in only one direction and orientation forming a keyed fit.

FIG. 6 shows three side perspective views of an example of different engagement states between a foot receiving member 900 and an upper resilient arched member 102 of a boot accessory 300 (FIGS. 1, 2, and 3) comprising a second interface assembly 201 according to various embodiments of the present invention.

Figure 6A:
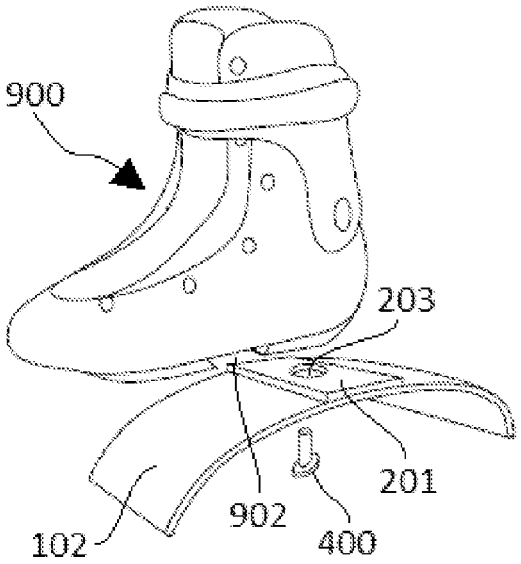
FIG. 6A shows a side perspective views of an example of an engagement states between a foot receiving member and an upper resilient arched member of a boot accessory of an exercise and sporting footwear apparatus according to various embodiments described herein.
Figure 6B:
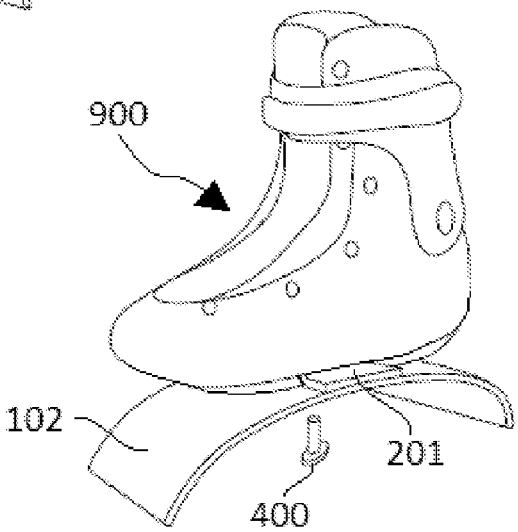
FIG. 6B shows a side perspective views of an example of an engagement states between a foot receiving member and an upper resilient arched member of a boot accessory of an exercise and sporting footwear apparatus according to various embodiments described herein.

To attach a disengaged footwear receiving member 900 and a boot accessory 300 (FIGS. 1, 2, and 3) as shown in FIG. 6A, the second interface assembly may slide in, and is therefore is slidably engaged into, the recessed opening 902 as shown in FIG. 6B. Once the second interface assembly 201 is fully engaged into the recessed opening 902 as shown in FIG. 6C, a fastener 400 may be inserted through the securing fastener aperture 203 and secured into the footwear receiving member 900.

Figure 6C:
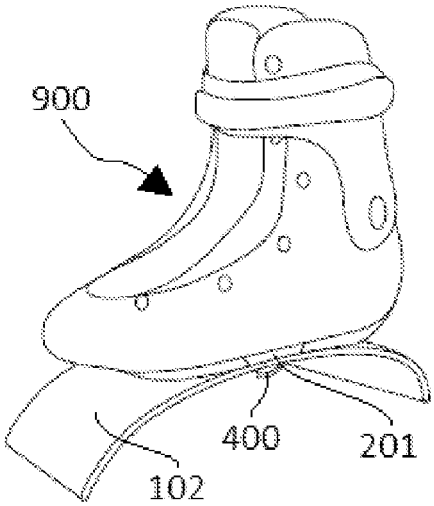
FIG. 6C shows a side perspective views of an example of an engagement states between a foot receiving member and an upper resilient arched member of a boot accessory of an exercise and sporting footwear apparatus according to various embodiments described herein.

To detach an engaged footwear receiving member 900 and a boot accessory 300 (FIGS. 1, 2, and 3) as shown in FIG. 6C, the fastener 400 is first unsecured from the footwear receiving member 900 and removed from the securing fastener aperture 203. Next, the second interface assembly 201 is slidably disengaged out of the recessed opening 902 as shown in FIG. 6B until the footwear receiving member 900 is fully separated from the second interface assembly 201 of a boot accessory 300 (FIGS. 1, 2, and 3) as shown in FIG. 6A. Note in this example and in preferred embodiments, second interface assembly 201 is configured to horizontally or laterally slide into first interface assembly 901 on foot receiving member 900. Vertical movement between first interface assembly 901 and second interface assembly 201 is restricted by various means, for example, by having angled sidewalls (202/903 FIG. 5) on the interface assemblies.

Turning now to FIG. 7, two side perspective views of an example of an elongate tension member 109 according to various embodiments of the present invention are depicted. The elongate tension member 109 is configured to be elastic in nature allowing it to longitudinally stretch when under load and then return to its original length when not under load. Suitable materials for the elongate tension member 109 include rubber, silicone, elastic plastics, metal springs, or any other suitable elastic material.

Figure 7A:
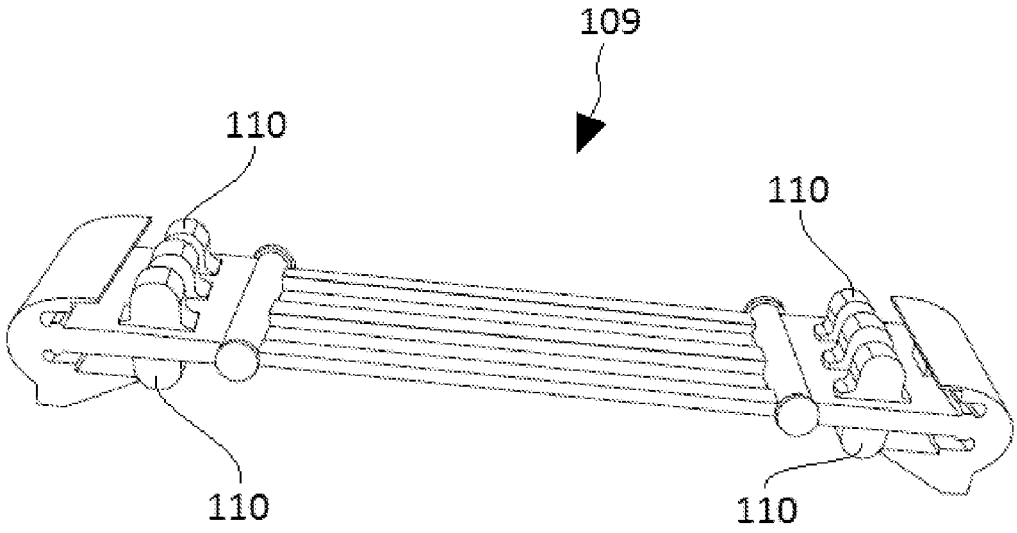
FIG. 7A depicts a side perspective views of an example of an elongate tension member of an exercise and sporting footwear apparatus according to various embodiments described herein.
Figure 7B:
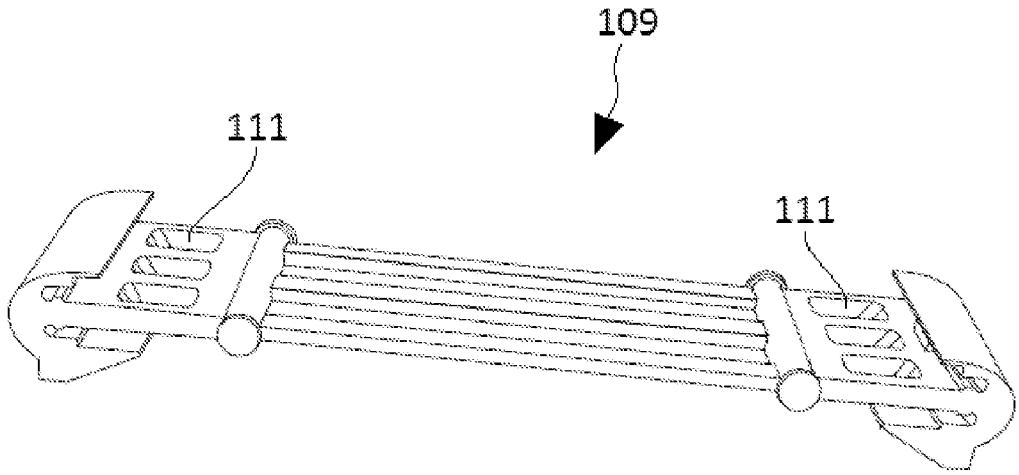
FIG. 7B depicts a side perspective views of an example of an elongate tension member of an exercise and sporting footwear apparatus according to various embodiments described herein.

Also depicted in FIG. 7A are a plurality of impact absorbing members 110 which are secured in a plurality of absorbing member cavities 111 (FIG. 7B). The impact absorbing members 110 are configured to prevent excess deformation of a first resilient arched member 102 and second arched resilient member 104 (FIGS. 1, 2, and 3) by contacting a first resilient arched member 102 and second arched resilient member 104, absorbing the energy from an impact, and then rebounding the energy to aid the jump or bounce of a user. Suitable materials for the impact absorbing members 110 include rubber, silicone, elastic plastics, metal springs, or any other suitable energy absorbing and rebounding material.

In preferred embodiments and as shown by FIG. 7, six impact absorbing members 110 may be temporarily secured within six absorbing member cavities 111 located within the elongate tension member 109 and allowing the user to remove and replace one or more impact absorbing members 110 as needed. In other embodiments, the impact absorbing members 110 may be permanently secured within the absorbing member cavities 111. In further embodiments, the elongate tension 109 may be configured without impact absorbing members 110 or absorbing member cavities 111. The impact absorbing members 110 may be configured to be slightly larger than the absorbing member cavities 111 so that compression secures them within the absorbing member cavities 111. In some embodiments, the elongate tension member 109 may be configured with one, two, three, four, five, six, seven, eight, nine, or even ten absorbing member cavities 111 configured to hold one, two, three, four, five, six, seven, eight, nine, or even ten impact absorbing members 110.

Figure 8A:
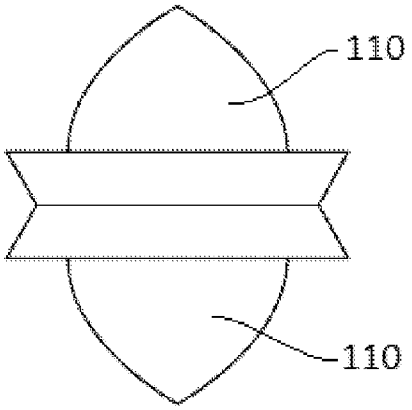
FIG. 8A illustrates a side profile view of an example of an impact absorbing member of an exercise and sporting footwear apparatus according to various embodiments described herein.
Figure 8B:
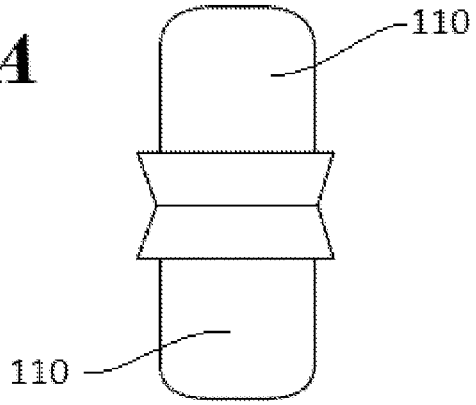
FIG. 8B illustrates a side profile view of an example of an impact absorbing member of an exercise and sporting footwear apparatus according to various embodiments described herein.
Figure 8C:
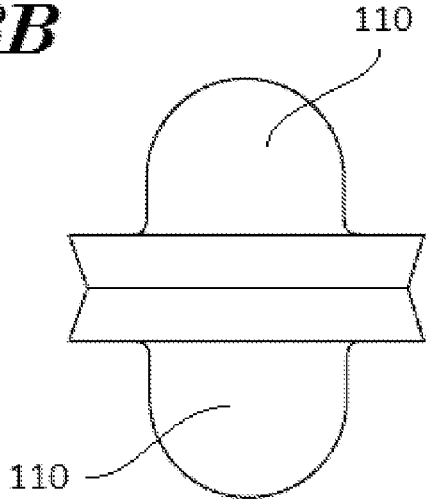
FIG. 8C illustrates a side profile view of an example of an impact absorbing member of an exercise and sporting footwear apparatus according to various embodiments described herein.

The impact absorbing members 110 may comprise various shapes as illustrated in three exemplary embodiments depicted in FIG. 8. In some embodiments, one or more impact absorbing members 110 may terminate along the vertical axis in a substantially blunt pointed shape (FIG. 8A). In other embodiments, one or more impact absorbing members 110 may terminate along the vertical axis in a substantially flat shape with blunted corners (FIG. 8B). In further embodiments, one or more impact absorbing members 110 may terminate along the vertical axis in a substantially rounded shape (FIG. 8C). In still further embodiments, one or more impact absorbing members 110 may terminate along the vertical axis in any other shape that will not produce excessive wear on a first resilient arched member 102 and second arched resilient member 104 (FIGS. 1, 2, and 3). In yet still further embodiments, the one or more impact absorbing members 110 may have terminal ends of a non semi-elliptical shape.

Figure 9A:
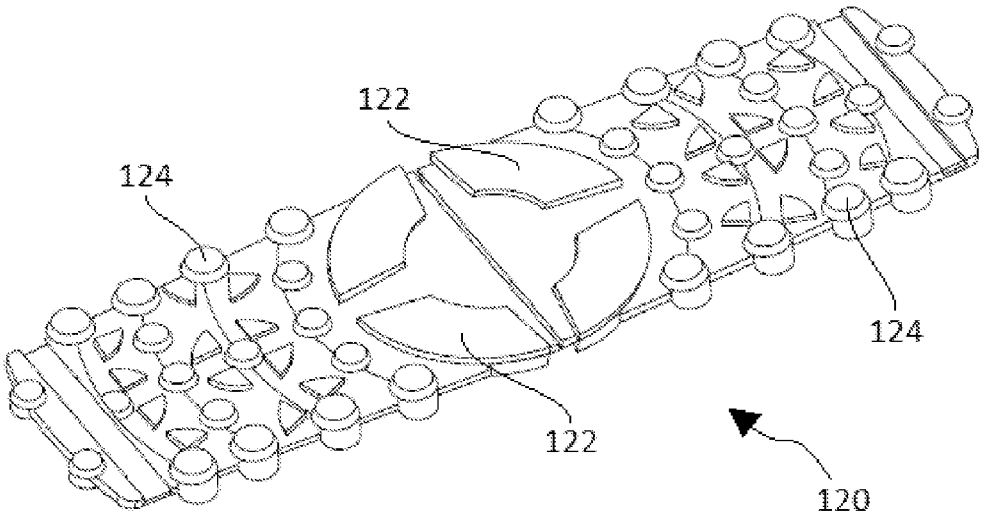
FIG. 9A shows a bottom perspective view of an example of a self balancing tread of an exercise and sporting footwear apparatus according to various embodiments described herein.
Figure 9B:
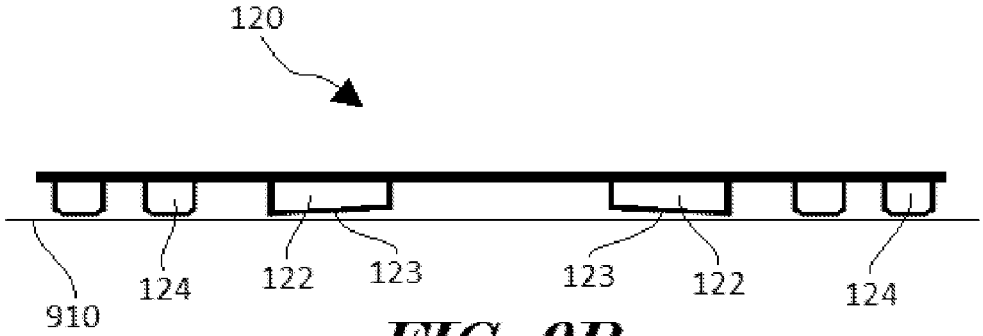
FIG. 9B shows a side profile view of an example of a self balancing tread of an exercise and sporting footwear apparatus according to various embodiments described herein.
Figure 9C:
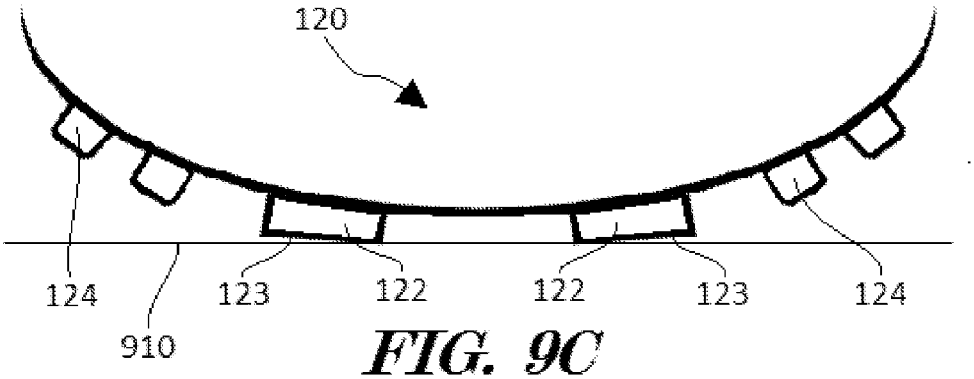
FIG. 9C shows a side profile view of an example of a self balancing tread of an exercise and sporting footwear apparatus according to various embodiments described herein.

Referring now to FIG. 9, an example of a self balancing tread 120 according to various embodiments of the present invention is shown. The self balancing tread 120 comprises a plurality of raised tread contact points 124 and radial support platforms 122 which are configured to increase traction between the self balancing tread 120 and a ground surface 910. In preferred embodiments, the self balancing tread 120 comprises four radial support platforms 122 arranged in a substantially circular shape (FIG. 9A). Each of the radial support platforms 122 preferably comprise a radial support platform sloped edge 123 configured to stabilize the self balancing tread 120 by being angled to provide a larger area of contact with a ground surface 910 when the self balancing tread 120 is in a flexed configuration as shown in FIG. 9C.

Figure 10A:
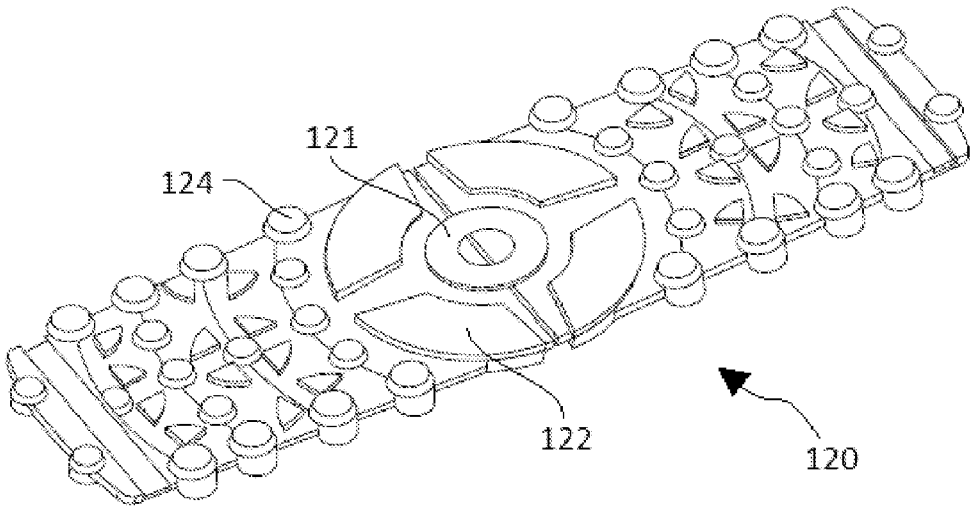
FIG. 10A shows a bottom perspective view of an example of a self balancing tread of an exercise and sporting footwear apparatus according to various embodiments described herein.
Figure 10B:
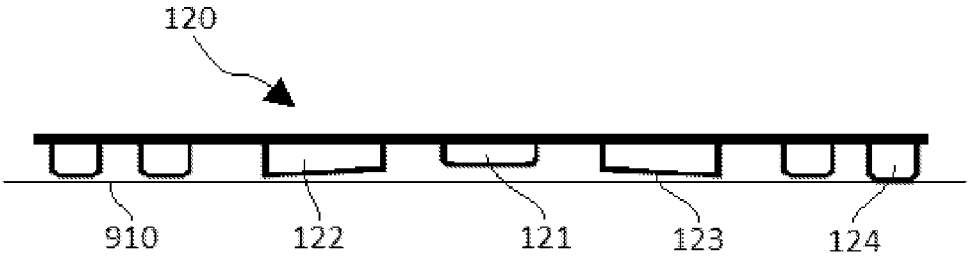
FIG. 10B shows a side profile view of an example of a self balancing tread of an exercise and sporting footwear apparatus according to various embodiments described herein.
Figure 10C:
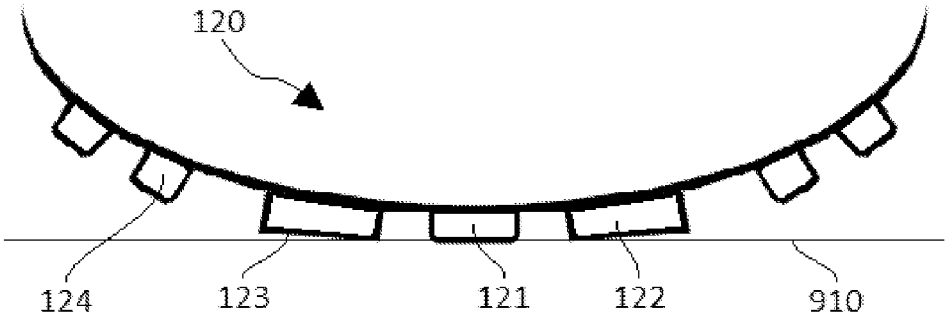
FIG. 10C shows a side profile view of an example of a self balancing tread of an exercise and sporting footwear apparatus according to various embodiments described herein.

Another example of a self balancing tread 120 according to various embodiments of the present invention is illustrated in FIG. 10. In this embodiment, the self balancing tread 120 further comprises a raise central platform 121 to further increase traction between the self balancing tread 120 and a ground surface 910 in addition to the plurality of radial support platforms 122 and raised tread contact points 124. Suitable materials for the raise central platform 121, radial support platforms 122, and raised tread contact points 124 include rubber, silicone, soft plastics, or any other material comprising the soles of footwear. In some embodiments, the self balancing tread 120 is configured to cover all or substantially all of the ground facing surface of the second resilient arched member 104. In some embodiments, the self balancing tread 120 is configured to cover about 90% of the ground facing surface of the second resilient arched member 104.

Figure 11:
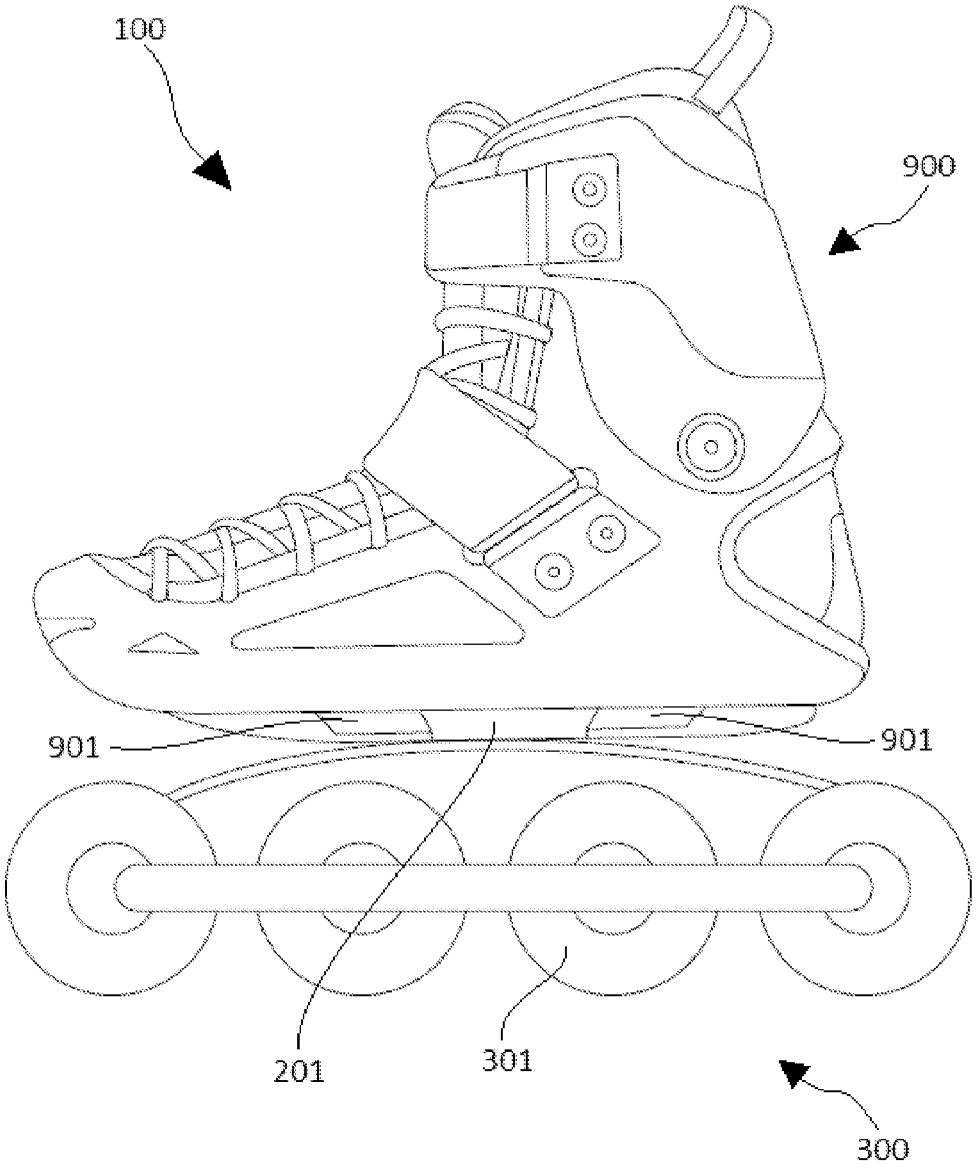
FIG. 11 illustrates a side profile view of an example of a boot accessory mounted to a foot receiving member of an exercise and sporting footwear apparatus known as roller blades according to various embodiments described herein.

FIG. 11 illustrates a side profile view of an example of a boot accessory 300 engaged to a foot receiving member 900 of an exercise and sporting footwear apparatus 100 according to various embodiments of the present invention. A plurality of boot accessories comprising a second interface assembly 201 are contemplated for attachment to a foot receiving member 900 comprising first interface assembly 901. In this embodiment, the boot accessory comprises an in-line wheeled skating device comprising four wheels 301. In other embodiments, any other type of footwear sporting device, such as ice skates, skis, snow shoes, etc. comprising a second interface assembly 201 may be attached to a footwear device 900 comprising a first interface assembly 901.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An apparatus, comprising:

a first resilient arched member having a front end zone opposite to a rear end zone, and being configured to securely couple with a foot receiving member;

a second resilient arched member having a front end zone opposite to a rear end zone, and being configured to contact a ground surface;

a first connection element being configured to connect a front end zone of the first resilient arched member with a front end zone of the second resilient arched member;

a second connection element longitudinal spaced apart from the first connection element with said second connection element being configured to connect a rear end zone of the first resilient arched member with a rear end zone of the second resilient arched member;

a first rotation-opposing assembly being located proximate to the first connection element extending from the first connection element toward a ground surface, the rotation-opposing assembly being configured to limit an amount of rotational motion of the apparatus and comprising a lateral extension region being configured to extend laterally out and away from the first connection element and a ground contacting region being configured to extend vertically below said lateral extension region; and a second rotation-opposing assembly being located proximate to the second connection element extending from the second connection element toward a ground surface, the second rotation-opposing assembly being configured to limit an amount of rotational motion of the apparatus and comprising a lateral extension region being configured to extend laterally out and away from the second connection element and a ground contacting region being configured to extend vertically below said lateral extension region.

2. The apparatus according to claim 1, wherein:

the first rotation-opposing assembly forms a first terminal end of an elongate tension member at the first connection element and the second rotation-opposing assembly forms a second terminal end of the elongate tension member at the second connection element.

3. The apparatus according to claim 2, wherein the ground contacting region terminates with a substantially flat planar surface configured to contact the ground.

4. The apparatus according to claim 2, wherein: the ground contacting region terminates with a substantially round surface configured to contact the ground to oppose further rotational movement of the first resilient arched member.

5. The apparatus according to claim 1, wherein:

the first rotation-opposing assembly is removably connected to the terminal end of an elongate tension member at the first connection element; and the second rotation-opposing assembly is removably connected to the terminal end of the elongate tension member at the second connection element.

6. The apparatus according to claim 4, wherein: the ground contacting region terminates with a substantially flat planar surface configured to contact the ground to oppose further rotational movement of the first resilient arched member.

7. The apparatus according to claim 1, wherein the foot receiving member comprises a first interface assembly and the first resilient arched member contains a second interface assembly on its upper surface configured to removably connect with the first interface assembly of the foot receiving member.

8. The apparatus according to claim 1, wherein:

the first rotation-opposing assembly forms a first terminal end of an elongate tension member and first connection element; and the second rotation-opposing assembly forms a second terminal end of the elongate tension member and second connection element.

9. The apparatus according to claim 8, wherein: the ground contacting region terminates with a substantially flat planer surface configured to contact the ground to oppose further rotational movement of the first resilient arched member.

10. The apparatus according to claim 8, wherein: the ground contacting region terminates with a substantially round surface configured to contact the ground to oppose further rotational movement of the first resilient arched member.

11. The apparatus according to claim 8, wherein:

the first rotation-opposing assembly is removably connected to the first terminal end of the first connection element; and the second rotation-opposing assembly is removably connected to the second terminal end of the second connection element.

12. The apparatus according to claim 11, wherein: the ground contacting region terminates with a substantially flat planar surface configured to contact the ground to oppose further rotational movement of the first resilient arched member.

13. The apparatus according to claim 11, wherein: the ground contacting region terminates with a substantially round surface configured to contact the ground to oppose further rotational movement of the first resilient arched member.

* * * * *